US007078373B2

(12) United States Patent
Burrows et al.

(10) Patent No.: US 7,078,373 B2
(45) **Date of Patent: *Jul. 18, 2006**

(54) LAUNDRY DETERGENT COMPOSITION

(75) Inventors: Jacqueline Burrows, Wirral (GB); Robert John Crawford, Wirral (GB); Patrick Joseph Norris, Wirral (GB); David Christopher Thorley, Wirral (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 168 days.

This patent is subject to a terminal disclaimer.

(21) Appl. No.: 10/699,996

(22) Filed: Nov. 3, 2003

(65) Prior Publication Data

US 2004/0097394 A1 May 20, 2004

(30) Foreign Application Priority Data

Nov. 4, 2002 (GB) ..... 0225668.3
Aug. 13, 2003 (GB) ..... 0319025.3

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/37*** | (2006.01) |
| ***C11D 17/00*** | (2006.01) |

(52) U.S. Cl. ..... 510/351; 510/356; 510/357; 510/360; 510/421; 510/426; 510/434; 510/446; 510/475; 510/504; 510/535; 8/137

(58) Field of Classification Search ..... 510/351, 510/356, 357, 360, 421, 426, 434, 446, 475, 510/504, 535; 8/137
See application file for complete search history.

(56) References Cited

U.S. PATENT DOCUMENTS

| | | | | |
|---|---|---|---|---|
| 4,294,711 | A | 10/1981 | Hardy et al. | 252/8.75 |
| 4,880,569 | A | 11/1989 | Leng et al. | 252/550 |
| 5,602,090 | A | 2/1997 | Melikyan et al. | 510/372 |
| 5,789,370 | A | 8/1998 | Thomas et al. | 510/424 |
| 5,952,285 | A | 9/1999 | Hawkins | 510/405 |
| 6,177,396 | B1 | 1/2001 | Clapperton et al. | 510/405 |
| 6,689,735 | B1 * | 2/2004 | Singh et al. | 510/422 |
| 6,720,298 | B1 * | 4/2004 | Blything et al. | 510/351 |
| 6,759,380 | B1 * | 7/2004 | Singh et al. | 510/351 |
| 2002/0137656 | A1 | 9/2002 | Blything et al. | 510/421 |
| 2004/0097394 | A1 * | 5/2004 | Burrows et al. | 510/421 |

FOREIGN PATENT DOCUMENTS

| | | | |
|---|---|---|---|
| EP | 008 829 | | 3/1980 |
| EP | 125 854 | | 11/1984 |
| EP | 293 139 | | 11/1988 |
| EP | 638 638 | | 2/1995 |
| EP | 687 727 | | 12/1995 |
| GB | 1 399 966 | | 7/1975 |
| GB | 1 542 696 | | 3/1979 |
| GB | 2 179 054 | | 2/1987 |
| JP | 63061093 | * | 3/1988 |
| JP | 01066298 | * | 3/1989 |
| JP | 2000026894 | | 1/2000 |
| WO | 93/02176 | | 2/1993 |
| WO | 94/16052 | | 7/1994 |
| WO | 02/45530 | | 6/2002 |
| WO | 02/48297 | | 6/2002 |

OTHER PUBLICATIONS

PCT International Search Report in a PCT application, PCT/EP 03/12067.
Japanese Abstract JP 01 066298 published Mar. 13, 1989.
Japanese Abstract JP 63 061093—published Sep. 1, 1986.
GB Search Report in a GB application GB 0225668.3.
Co-pending Application: Applicant: Blything et al., U.S. Appl. No. 10/013,790; Filed: Feb. 11, 2001.
Co-pending Application: Applicant: Singh et al., U.S. Appl. No. 10/013,754; Filed: Dec. 11, 2001.

* cited by examiner

*Primary Examiner*—Brian P Mruk
(74) *Attorney, Agent, or Firm*—Rimma Mitelman

(57) ABSTRACT

The detergent composition of the invention contains a combination of an anionic surfactant, a defined nonionic surfactant of high hydrophilic/lipophilic balance (HLB) value, optionally a cationic surfactant, optionally a detergency builder, optionally an inorganic non-builder salt, an optionally a polycarboxylate polymer. Further optional detergent ingredients may also be present. The amount of the anionic surfactant is from 5 to 40, preferably from 7 to 30 wt % and the amount of the nonionic surfactant is from 1 to 20, preferably from 1 to 10 wt %, based on the weight of the total composition.

20 Claims, No Drawings

LAUNDRY DETERGENT COMPOSITION

TECHNICAL FIELD

The present invention relates to laundry detergent compositions containing a combination of anionic and specified nonionic surfactants giving improved stain removal.

BACKGROUND OF THE INVENTION

Laundry detergent compositions have for many years contained anionic sulphonate or sulphate surfactant, for example, linear alkylbenzene sulphonate (LAS), together with ethoxylated alcohol nonionic surfactants. Examples abound in the published literature. Conventional ethoxylated alcohol nonionic surfactants used in laundry detergent compositions are typically $C_{10}$–$C_{16}$ alcohols having an average degree of ethoxylation of 3 to 8.

Agglomeration of insoluble complexes of calcium in hard water due to the reaction of calcium ions with the anionic surfactant is a well known problem, which is usually avoided by the use of a builder, such as STP, or zeolite which removes calcium ions from the wash liquor. Without builder, detergency performance falls significantly as water hardness increases.

It has now surprisingly been found that the combination of anionic surfactant with nonionic surfactants having high hydrophilic/lipophillic balance (HLB) values, can give enhanced stain removal at a wide range of water hardnesses, especially at high water hardness, even when no builder is present.

PRIOR ART

WO 02 48297A (Unilever) discloses a built laundry detergent composition containing a combination of anionic, a highly ethoxylated nonionic (20 to 50 EO) and cationic surfactants, and 10 to 80 wt % of detergency builder.

WO 94 16052A (Unilever) discloses high bulk density laundry powders based on LAS and conventional nonionic surfactants, and containing small amounts of very highly ethoxylated alcohols, e.g. tallow alcohol 80 EO, as a dissolution aid, also containing 5 to 80 wt % of a detergency builder.

WO 93 02176A (Henkel) discloses the use of highly ethoxylated aliphatic alcohols as "structure breakers" in high bulk density powders containing conventional nonionic surfactants and at least 10 wt % of zeolite.

EP 293 139A (Procter & Gamble) discloses twin-compartment sachets containing detergent powders. Some powders contain very small amounts of tallow alcohol 25EO and 15 to 90 wt % builder materials.

U.S. Pat. No. 4,294,711 (Procter & Gamble) discloses a textile softening heavy duty built detergent composition containing 1 wt % of tallow alcohol 80EO and 10 to 80 wt % of builder.

GB 1399966 (Procter & Gamble) discloses a granular, spray dried detergent composition containing nonionics with 3 to 10 moles of ethylene oxide, and a HLB of from 10 to 13.5.

DEFINITION OF THE INVENTION

According to a first aspect of the invention, there is provided a laundry detergent composition comprising (i) from 5 to 40 wt %, preferably from 7 to 30 wt %, of an anionic surfactant, (ii) from 1 to 20 wt %, preferably from 1 to 10 wt %, more preferably from 2 to 6 wt %, most preferably from 3 to 5 wt %, of a nonionic surfactant having a hydrophilic/lipophilic balance (HLB value) of from 13 to 25, preferably from 15 to 22, most preferably from 16 to 22, (iii) optionally from 0 to 50 wt % of a cationic surfactant, (iv) optionally from 0 to less than 10 wt % of a detergency builder, (v) optionally from 0 to 85 wt % of an inorganic non-builder salt, (vi) optionally from 0 to 3 wt % of a polycarboxylate polymer, and (vii) optionally other detergent ingredients to 100 wt %.

According to a second aspect of the invention, there is provided a process for laundering textile fabrics by machine or hand, which includes the step of immersing the fabrics in a wash liquor comprising water in which a laundry detergent composition as defined in the previous paragraph is dissolved or dispersed.

According to a third aspect of the invention, there is provided a use of a nonionic surfactant having a hydrophilic/lipophilic balance (HLB) value of from 13 to 25, preferably 15 to 22, most preferably 16 to 22, to improve the stain removal of laundry detergent compositions as previously defined.

DETAILED DESCRIPTION OF THE INVENTION

The detergent composition of the invention contains a combination of an anionic surfactant, a defined nonionic surfactant of high hydrophilic/lipophilic balance (HLB) value, optionally a cationic surfactant, optionally a limited amount of detergency builder, optionally an inorganic non-builder salt and optionally a polycarboxylate polymer. Further optional detergent ingredients may also be present.

Detergent compositions according to the invention show improved stain removal across a range of fabrics and water hardnesses.

The Anionic Surfactant (i)

Anionic surfactants are well-known to those skilled in the art. Many suitable detergent-active compounds are available and are fully described in the literature, for example, in "Surface-Active Agents and Detergents", Volumes I and II, by Schwartz, Perry and Berch.

Examples include alkylbenzene sulphonates, branched or linear alkyl benzene sulphonates, primary and secondary alkylsulphates, particularly $C_8$–$C_{16}$ primary alkyl sulphates; alkyl ether sulphates, olefin sulphonates, including alpha olefin sulphonates, fatty alcohol sulphates such as primary alcohol sulphates, alkane sulphonates, alkyl xylene sulphonates, dialkyl sulphosuccinates, and fatty acid ester sulphonates, and alkyl carboxylates. Also suitable are ether sulphates such as sodium lauryl ether sulphate (SLES). These may be present as sodium, potassium, calcium or magnesium salts or mixtures of these. Sodium salts are generally preferred.

The anionic surfactant is preferably a sulphonate or sulphate anionic surfactant. More preferably the anionic surfactant is linear alkylbenzene sulphonate or primary alcohol sulphate. Most preferably the anionic surfactant is linear alkylbenzene sulphonate. The linear alkyl benzene sulphonate may be present as sodium, potassium, or alkaline earth metal salts, or mixtures of these salts. Sodium salts are generally preferred.

The anionic surfactant is present in an amount of from 5 to 40 wt %, preferably from 7 to 30 wt %, based on the weight of the total composition.

The Nonionic Surfactant (ii)

The nonionic surfactant is any nonionic surfactant having a hydrophilic/lipophilic balance (HLB) value of from 13 to 25, preferably from 15 to 22, more preferably from 16 to 22, most preferably from 14 to 19.5.

HLB values can be calculated according to the method given in Griffin, J. Soc. Cosmetic Chemists, 5 (1954) 249–256.

For example, the HLB of a polyethoxylated primary alcohol nonionic surfactant can be calculated according to the following formula:

$$HLB = \frac{\mathrm{MW}(EO)}{\mathrm{MW}(Tot) \times 5} \times 100$$

where,

MW(EO)=the molecular weight of the hydrophilic (ethoxy) part

MW(Tot)=the molecular weight of the whole surfactant molecule

Nonionic surfactants suitable for use in the invention are preferably those having a large polar head group and a hydrocarbyl chain. For the sake of clarity, the polar head group should have hydrophilic character and the hydrocarbyl chain should be of hydrophobic character. Preferably, the large polar head group contains a hydrophilic repeating unit.

In a preferred embodiment of the invention the nonionic surfactant (ii) is preferably an alkoxylated alcohol nonionic surfactant.

Especially preferred alkoxylated alcohols are those having a Hydrophilic/Lipophilic Balance (HLB) value in the range of from 15 to 20, preferably 16 to 18.

In a preferred embodiment of the invention the compositions of the invention are preferably free from nonionic surfactants other than the defined nonionic surfactant (ii).

The nonionic surfactant is suitably present in an amount of from 1 to 20 wt %, preferably from 1 to 10, more preferably from 2 to 6 wt %, most preferably from 3 to 5 wt %, based on the weight of the total composition.

In a preferred embodiment of the invention the weight ratio of the anionic surfactant (i) to the nonionic surfactant (ii) is within the range of from 0.25:1 to 40:1, suitably 1:1 to 15:1, preferably from 1:1 to 10:1 and more preferably from 2:1 to 6:1, and most preferably from 2.5:1 to 5:1.

Nonionic Surfactant (ii)—Alkoxylated Alcohols

Examples of alkoxylated alcohols suitable for use as nonionic surfactant (ii) in the present invention include the condensation products of aliphatic ($C_8$–$C_{20}$, preferably $C_8$–$C_{16}$) primary or secondary linear or branched chain alcohols or phenols with alkylene oxides, preferably ethylene oxide or propylene oxide, most preferably ethylene oxide, and generally having from 15 to 80, preferably 16 to 80, more preferably up to 20 or from 20 to 80, and most preferably 20 to 50 alkylene oxide groups. For the sake of clarity, the alkylene oxide group is the hydrophilic repeating unit.

According to an especially preferred embodiment of the invention, the nonionic surfactant (ii) is an ethoxylated aliphatic alcohol of the formula (I):

$$R—(—O—CH_2—CH_2)_n—OH \qquad (I)$$

wherein R is a hydrocarbyl chain having from 8 to 16 carbon atoms, and the average degree of ethoxylation n is from 15 to 50, preferably 20 to 50.

The hydrocarbyl chain, which is preferably saturated, preferably contains from 10 to 16 carbon atoms, more preferably from 12 to 15 carbon atoms. In commercial materials containing a spread of chain lengths, these figures represent an average. The hydrocarbyl chain may be linear or branched.

The alcohol may be derived from natural or synthetic feedstock. Preferred alcohol feedstocks are coconut, predominantly $C_{12}$–$C_{14}$, and oxo $C_{12}$–$C_{15}$ alcohols.

The average degree of ethoxylation ranges from 15 to 50, preferably from 16 to 50, more preferably from 20 to 50, and most preferably from 25 to 40.

Preferred materials have an average alkyl chain length of $C_{12}$–$C_{16}$ and an average degree of ethoxylation of from 16 to 40, more preferably from 25 to 40.

An example of a suitable commercially available material is Lutensol A030, ex BASF, which is a $C_{13}$–$C_{15}$ alcohol having an average degree of ethoxylation of 30. Another example of a suitably commercially available material is a nonionic ethoxylated alcohol 20EO Genapol C200 ex Clariant, and also the nonionic ethoxylated alcohol 20EO Lutensol T020 ex BASF.

The compositions of the invention may contain non-ionic surfactants other than the defined nonionic surfactant (ii) described above. Preferably, however, the compositions of the invention are free from nonionic surfactants other than the defined nonionic surfactant (ii).

The Optional Cationic Surfactant (iii)

Preferred water-soluble cationic surfactants are quaternary ammonium salts of the general formula III $$R_1R_2R_3R_4N_+X_- \qquad (III)$$

wherein $R_1$ is a relatively long ($C_8$–$C_{18}$) hydrocarbyl chain, typically an alkyl, hydroxyalkyl or ethoxylated alkyl group, optionally interrupted with a heteroatom or an ester or amide group; each of $R_2$, $R_3$ and $R_4$ (which may be the same or different) is a short-chain ($C_1$–$C_3$) alkyl or substituted alkyl group; and X is a solubilising anion, for example a chloride, bromide or methosulphate ion.

A preferred cationic surfactant is a quaternary ammonium compound of the formula II in which $R_1$ is a $C_8$–$C_{18}$ alkyl group, more preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups. Such compounds have the formula IV:

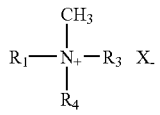

(IV)

In an especially preferred compound, $R_1$ is a $C_{12}$–$C_{14}$ alkyl group, $R_2$ and $R_3$ are methyl groups, $R_4$ is a 2-hydroxyethyl group, and $X_3$ is a chloride ion. This material is available commercially as Praepagen (Trade Mark) HY from Clariant GmbH, in the form of a 40 wt % aqueous solution.

Other classes of cationic surfactant include cationic esters (for example, choline esters).

The cationic surfactant is optionally present in an amount of from 0 to 50 wt %, preferably from 0 to 10 wt %, more preferably 1 to 5 wt %, based on the weight of the total composition.

The Optional Detergency Builder (iv)

The compositions of the invention may contain a detergency builder. Preferably the builder is present in an amount of from 0 to less than 10 wt % based on the weight of the total composition. More preferably the amount of builder is from 0 to 5 wt %, and does not exceed 5 wt %. Most preferably, the compositions are essentially free of detergency builder.

According to a preferred embodiment of the invention the composition is essentially free of aluminosilicate, that is the composition is free of zeolite. The composition may also be free of sodium tripolyphosphate.

The optional builder may be selected from strong builders such as phosphate builders, aluminosilicate builders and mixtures thereof. However, strong builders are preferably present in an amount not exceeding 5 wt %, and most preferably strong builders are absent. One or more weak builders such as calcite/carbonate, beryllium/carbonate, citrate or polymer builders may be additionally or alternatively present.

The phosphate builder (if present) may for example be selected from alkali metal, preferably sodium, pyrophosphate, orthophosphate and tripolyphosphate, and mixtures thereof.

The aluminosilicate (if present) may be, for example, selected from one or more crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst The alkali metal aluminosilicate may be either crystalline or amorphous or mixtures thereof, having the general formula: 0.8–1.5 $Na_2O$. $Al_2O_3$. 0.8–6 $SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Suitably zeolite MAP may be used, having a silicon to aluminium ratio not exceeding 1.07, more preferably about 1.00. The calcium binding capacity of zeolite MAP is generally at least 150 mg CaO per g of anhydrous material.

The Optional Inorganic Non-Builder Salt (v)

The compositions of the invention may contain from 0 to 85 wt % of an inorganic non-builder salt, preferably from 1 to 80 wt %, more preferably from 10 to 75 wt %, most preferably from 20 to 65 wt %, based on the weight of the total composition.

The inorganic non-builder salt (v) may be present in an amount of from 0 to 60 wt %, preferably from 1 to 40 wt %, based on the weight of the total composition.

These are included in order to increase detergency and ease processing.

Suitable inorganic non-builder salts include alkaline agents such as alkali metal, preferably sodium, carbonates, sulphates, silicates, metasilicates as independent salts or as double salts etc, which for the purposes of this specification, are not to be considered as builders.

Preferably the inorganic non-builder salt (v) is selected from the group consisting of sodium carbonate, sodium bicarbonate, sodium sulphate, burkeite, sodium silicate and mixtures thereof.

A preferred alkali metal carbonate is sodium carbonate. The sodium carbonate may be present in a dense or light form. Sodium carbonate may suitably be present in amounts ranging from 1 to 60 wt %, preferably from 10 to 50 wt %, more preferably from 20 to 40 wt %, based on the weight of the total composition. These amounts are most relevant when a spray drying process is used to make the formulation. If a non-tower processing route is used to make the formulation the sodium carbonate may be present in an amount of from 30 to 80 wt %, preferably 40 to 70 wt %, based on the weight of the total composition.

However, compositions containing little or no sodium carbonate are also within the scope of the invention.

Sodium sulphate may suitably be present in an amount of from 10 to 50 wt %, preferably from 15 to 40 wt %, based on the weight of the total composition. Compositions containing little or none of the independent solid sodium sulphate are also within the scope of the invention.

The composition according to the invention preferably may comprise sodium carbonate and sodium sulphate, wherein the total amount of sodium carbonate and sodium sulphate is of from 40 to 80 wt %, and preferably from 60 to 70 wt %, based on the weight of the total composition.

The composition according to the invention may comprise a ratio of sodium carbonate to sodium sulphate within the range of from 0.1:1 to 5:1, preferably 0.5:1 to 1.5:1, most preferably from 1:1.

Burkeite may suitably be present in an amount of from 40 to 80 wt %, preferably from 60 to 70 wt %, based on the weight of the total composition. Compositions containing burkeite as the only non-builder salt are within the scope of the invention, as are compositions containing little or no burkeite. Burkeite is of the formula $Na_2CO_3.2Na_2SO_4$, and this is different from sodium carbonate and sodium sulphate as previously described as it is a double salt comprised of the combination of sodium carbonate and sodium sulphate.

In addition to the inorganic non-builder salts listed above the detergent composition according to the invention may further comprise sodium silicate, the sodium silicate may be present at levels of from 0 to 20 wt %, preferably from 1 to 10 wt %, based on the weight of the total composition. Preferably the total amount of sodium carbonate, sodium sulphate, burkeite and sodium silicate is from 50 to 85 wt %, most preferably from 65 to 80 wt %, based on the weight of the total composition.

Further suitable inorganic non-builder salts include sodium sesquicarbonate, sodium chloride, calcium chloride and magnesium chloride.

The Optional Polycarboxylate Polymer (vi)

The compositions of the invention may contain a polycarboxylate polymer. These include homopolymers and copolymers of acrylic acid, maleic acid and acrylic/maleic acids. The publication 'Polymeric Dispersing Agents, Sokalan', a printed publication of BASF Aktiengesellschaft, D-6700 Ludwigshaven, Germany describes organic polymers which are useful.

Preferably the polycarboxylate polymer is selected from the group consisting of sodium polyacrylate, sodium acrylate maleate and mixtures thereof.

Suitable polymers are generally at least partially neutralised in the form of their alkali metal ammonium or other conventional cation salts. The alkali metal especially sodium salts are most preferred. The molecular weight of such polymers can vary over a wide range, it is preferably from 1,000 to 500,000, more preferably from 2, 000 to 250,000, and most preferably from 3,000 to 100,000.

Unsaturated monomeric acids that can be polymerised to form suitable polymeric polymeric polycarboxylates include maleic acid (or maleic anhydride), fumaric acid itaconic acid, aconitic acid, mesaconic acid, citraconic acid and methylenemalonic acid. The presence of monomeric segments containing no carboxylate groups such as vinylmethyl ether, styrene, ethylene etc is suitable. Another suitable polymer is copolymers of acrylamide. Also acrylate/maleate copolymers. Other suitable copolymers based on a mixture of unsaturated mono- and dicarboxylate monomers are also suitable.

Examples of suitable polymers include ISP Gantrez AN 119 maleic polyvinyl ether anhydride, also Ciba Versicol E5 polyacrylate, and Sokalan CP5, ex BASF polyacrylate, namely maleic acid-acrylic acid copolymer, with a sodium salt. Especially preferred is Sokalan PA 40, ex BASF a sodium polyacrylate with a molecular weight of 30,000.

The Other Optional Detergent Ingredients (vii)

As well as the surfactants and builders discussed above, the compositions may optionally contain other active ingredients to enhance performance and properties.

The detergent composition may further comprise one or more additional surfactants in an amount of from 0 to 50 wt %, and preferably from 0 to 10 wt %. Additional surfactants or detergent active compounds may comprise other nonionics such as alkylpolyglucosides, polyhydroxyamides (glucamide), and glycerol monoethers. Also amphoteric surfactants and/or zwitterionic surfactants may be present. Preferred amphoteric surfactants are amine oxides, for example coco dimethyl amine oxide. Preferred zwitterionic surfactants are betaines, and especially amidobetaines. Preferred betaines are C8 to C18 alkyl amidoalkyl betaines, for example coco amido betaine. These may be included as co-surfactants. Many suitable detergent active compounds are available and are fully described in the literature, for example in "Surface-Active Agents and Detergents", volumes I and II by Schwartz, Perry, and Berch.

The detergent compositions of the invention may comprise one or more optional ingredients selected from soap, peroxyacid and persalt bleaches, bleach activators, air bleach catalysts, sequestrants, cellulose ethers and esters, cellulosic polymers, other antiredeposition agents, sodium chloride, calcium chloride, sodium bicarbonate, other inorganic salts, fluorescers, photobleaches, polyvinyl pyrrolidone, other dye transfer inhibiting polymers, foam controllers, foam boosters, acrylic and acrylic/maleic polymers, proteases, lipases, cellulases, amylases, other detergent enzymes, citric acid, soil release polymers, silicone, fabric conditioning compounds, coloured speckles such as blue speckles, and perfume. This list is not intended to be exhaustive.

Yet other materials that may be present in detergent compositions of the invention lather control agents or lather boosters as appropriate; dyes and decoupling polymers.

Suitable lather boosters for use in the present invention include cocamidopropyl betaine (CAPB), cocomonoethanolamide (CMEA) and amine oxides.

Preferred amine oxides are of the general form:—

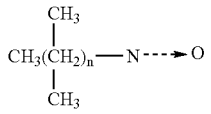

where, n is from 7 to 17.

A suitable amine oxide is Admox (Trademark) 12, supplied by Albemarle.

Bleaches

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

Alternatively the present invention may be used in a formulation that is used to bleach via air, or an air bleach catalyst system. In this regard the bleaching composition substantially devoid of a peroxygen bleach or a peroxy-based or peroxyl-generating bleach system.

The term "substantially devoid of a peroxygen bleach or a peroxy-based or peroxyl-generating bleach system" should be construed within spirit of the invention. It is preferred that the composition has as low a content of peroxyl species present as possible. It is preferred that the bleaching formulation contains less that 1% wt/wt total concentration of peracid or hydrogen peroxide or source thereof, preferably the bleaching formulation contains less that 0.3% wt/wt total concentration of peracid or hydrogen peroxide or source thereof, most preferably the bleaching composition is devoid of peracid or hydrogen peroxide or source thereof. In addition, it is preferred that the presence of alkyl hydroperoxides is kept to a minimum in a bleaching composition comprising the ligand or complex of the present invention.

In order to function as an air bleaching composition the bleaching composition comprises an organic substance which forms a complex with a transition metal for bleaching a substrate with atmospheric oxygen.

The bleach catalyst per se may be selected from a wide range of transition metal complexes of organic molecules (ligands). In typical washing compositions the level of the organic substance is such that the in-use level is from 0.05 μM to 50 mM, with preferred in-use levels for domestic laundry operations falling in the range 1 to 100 μM. Higher levels may be desired and applied in industrial textile bleaching processes.

Suitable organic molecules (ligands) for forming complexes and complexes thereof are found, for example in: WO-A-98/39098; WO-A-98/39406, WO 9748787, WO 0029537; WO 0052124, and WO0060045 the complexes and organic molecule (ligand) precursors of which are herein incorporated by reference. An example of a preferred catalyst is a transition metal complex of MeN4Py ligand (N,N-bis(pyridin-2-yl-methyl)-1,1-bis(pyridin-2-yl)-1-aminoethane).

Enzymes

The detergent compositions may also contain one or more enzymes. Suitable enzymes include the proteases, amylases, cellulases, oxidases, peroxidases, savinases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Other

Antiredeposition agents, for example cellulose esters and ethers, for example sodium carboxymethyl cellulose, may also be present. An example of a commercially available sodium carboxymethyl cellulose is Finnfix BDA (trademark), ex Noviant.

The compositions may also contain soil release polymers, for example sulphonated and unsulphonated PET/POET polymers, both end-capped and non-end-capped, and polyethylene glycol/polyvinyl alcohol graft copolymers such as Sokalan (Trade Mark) HP22. Especially preferred soil release polymers are the sulphonated non-end-capped polyesters described and claimed in WO 95 32997A (Rhodia Chimie).

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %, based on the weight of the total composition.

Form of the Composition

The compositions of the invention may be of any suitable physical form, for example, particulates (powders, granules, tablets), liquids, pastes, gels or bars.

According to one especially preferred embodiment of the invention, the detergent composition is in particulate form, preferably powder form.

The composition can be formulated for use as hand wash or machine wash detergents.

Preparation of the Compositions

The compositions of the invention may be prepared by any suitable process.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

Tablets may be prepared by compacting powders, especially "concentrated" powders.

Liquid detergent compositions may be prepared by admixing the essential and optional ingredients in any desired order to provide compositions containing the ingredients in the requisite concentrations.

The choice of processing route may be in part dictated by the stability or heat-sensitivity of the surfactants involved, and the form in which they are available.

In all cases, ingredients such as enzymes, bleach ingredients, sequestrants, polymers and perfumes may be added separately.

EXAMPLES

The invention will now be further illustrated by the following, non-limiting Examples, in which parts and percentages are by weight.

TABLE A

Materials used in the examples.

| Chemical | Active level % | Trade Name | Supplier |
|---|---|---|---|
| Sodium carbonate (light) | 100 | Light soda ash | Brunner Mond |
| Sodium carbonate (dense) | 100 | Dense soda ash | Brunner Mond |
| sodium silicate | 40–50 | *Crystal range | *Ineos Silicas |
| silica | 100 | *Gasil 200TP | *Ineos Silicas |
| linear alkylbenzene sulphonate (LAS)** | 98 | *Petralab 550 | Petresa |
| sodium tripolyphosphate (STP) | 100 | *Empiphos | Albright & Wilson |
| nonionic ethoxylated alcohol, 7EO, C13–C15 | 100 | *Synperonic A7 | *Uniqema |
| nonionic, ethoxylated alcohol, 20EO | 100 | *Genapol C200 | *Clariant |
| nonionic, 20EO, branched | 100 | *Lutensol T020 | *BASF |
| nonionic ethoxylated alcohol, 30EO, C13–C15 | 100 | *Lutensol AO30 | *BASF |
| sodium sulphate | 100 | Sodium sulphate | Chance and Hunt |
| sodium polyacrylate | 40 | *Sokalan PA 40 | *BASF |
| Sodium acrylate maleate | 40 | *Sokalan CP5 | *BASF |
| Silicone | 100 | *DB100 | *Dow Corning |

TABLE A-continued

Materials used in the examples.

| Chemical | Active level % | Trade Name | Supplier |
|---|---|---|---|
| Sodium Perborate Monohydrate | 100 | sodium perborate monohydrate | *Interox |
| Sodium carboxymethyl cellulose | 72 | *Finnfix BDA | *Noviant |
| Fluorescent whitening agent | 90 | *Tinopal CBS-X | *CIBA |

*Trade Mark
**neutralised to the sodium salt with NaOH

Example 1

Preparation of Laundry Compositions

Comparative examples A and B (i.e. not according to the invention), and Example 1 were prepared according to Table 1 below.

TABLE 1

| Component | weight % A | B | 1 |
|---|---|---|---|
| LAS | 21 | 21 | 19.7 |
| nonionic, 7EO, C13–C15 | 1.4 | 1.4 | — |
| nonionic, 30EO, C13–15 | — | — | 4.9 |
| STP | 34.5 | — | — |
| Sodium Carbonate (light) | 9.84 | 9.84 | 9.84 |
| Sodium Silicate | 4.92 | 4.92 | 4.92 |
| demineralised water | to 100 | to 100 | to 100 |

Example 2

Evaluation of Laundry Compositions: Removal of Soil from Cotton

The test cloths used were cotton and 10 cm×10 cm in size.

The soils used were:

Kitchen grease: soya bean oil (chosen as a typical greasy kitchen soil), coloured with a violet dye (0.08 wt %) to act as a visual indicator.

Dirty engine oil: EMPA 102 test cloth, supplied by EMPA test materials, St. Gallen, Switzerland.

Butter: EMPA 102 test cloth, supplied by EMPA test materials, St. Gallen, Switzerland.

For the kitchen grease, the cloth was soiled with 0.5 ml of the soil. The dirty engine oil and butter soils were present on the EMPA 102 test cloth.

Stain removal was assessed by washing the soiled test cloths with the detergent compositions given in Table 1 in a Brazilian Brasstemp washing machine on half load cycle, which gave the following conditions:

TABLE 2

| | |
|---|---|
| Temperature | about 25° C. |
| Liquor to cloth ratio | 27:1 |
| Product dosage | 2.0 g/l |
| Soak time | 26.5 min |
| Wash time (agitation) | 11.0 min |
| Rinse | 1 × 6.0 min |

The water used was of a range of hardnesses.

The reflectance ΔE, indicative of total colour change across the whole visible spectrum, of each test cloth was measured before and after the wash. The results, expressed as the difference ΔΔE between reflectance values ΔE before and after the wash, are shown in the following table.

TABLE 3

ΔΔE for stain removal from cotton by Example 1 (according to the invention) and Comparative Examples A and B (not according to the invention).

| | kitchen grease | | | dirty engine oil | | | butter | | |
|---|---|---|---|---|---|---|---|---|---|
| FH | A | B | 1 | A | B | 1 | A | B | 1 |
| 5 | 22.7 | 25.5 | 26.4 | 16.0 | 23.1 | 19.3 | 14.4 | 17.8 | 19.2 |
| 20 | 23.8 | 23.1 | 26.3 | 17.9 | 19.5 | 19.6 | 17.9 | 12.1 | 23.2 |
| 35 | 22.6 | 22.3 | 23.1 | 22.7 | 15.2 | 27.1 | 20.8 | 12.9 | 20.5 |
| 50 | 21.3 | 21.0 | 21.7 | 22.8 | 16.6 | 23.1 | 18.0 | 9.9 | 20.5 |

It will be seen that the composition of the invention gives a robust performance across a wide range of water hardnessness.

Example 3

Evaluation of Laundry Compositions: Removal of Soil from Knitted Polyester

The test cloth used was knitted polyester of 10 cm×10 cm in size.

The soil used was:

clay soil: yellow pottery clay suspended in demineralised water (10% wt/wt).

The cloth was soiled with 0.5 ml of the soil.

Stain removal was assessed by washing the soiled test cloth with the detergent compositions given in Table 1 as described for Example 2 above.

TABLE 4

ΔΔE for stain removal from knitted polyester by Example 1 (according to the invention) and Comparative Examples A and B (not according to the invention).

| | clay soil | | |
|---|---|---|---|
| FH | A | B | 1 |
| 5 | 35.3 | 32.7 | 32.5 |
| 20 | 34.9 | 30.6 | 36.7 |
| 35 | 32.9 | 28.3 | 34.1 |
| 50 | 31.8 | 27.8 | 33.3 |

It will be seen that the composition of the invention gives a robust performance across the range of water hardness-ness.

The invention will now be further illustrated by the following, non-limiting Examples, in which parts and percentages are by weight.

Example 4

A detergent powder comprising post dosed ingredients and a spray dried base powder is prepared wherein the sodium carbonate and sodium sulphate are in the form of a burkeite solid.

| Raw Material | Percent Formulation. |
|---|---|
| Base | |
| water | 4.53 |
| Sodium Silicate | 9.84 |
| Sodium LAS | 12.80 |
| nonionic, 30EO, C13–15 | 3.20 |
| Sodium Polyacrylate | 1.35 |
| Sodium Carbonate (light) | 28.00 |
| Sodium sulphate | 37.96 |
| Silicone | 0.01 |
| Post Dosed | |
| Sodium Perborate Monohydrate | 1.00 |
| Blue speckles | 0.50 |
| Fluorescent whitening agent | 0.13 |
| other detergent ingredients | 0.68 |
| Total percentage | 100.00 |

The process used to make the burkeite carrier spray dried powder is as follows. Ingredients were made into a 40–50% slurry with water then they were spray dried. The order of addition to prepare the slurry was first of all to add water and caustic solution and heat to 50° C. Next polymer and liquid nonionic was added and this was heated to 70° C. Then sodium sulphate was added and dissolved for 2 min heating to 81° C. Next light soda ash was added in 2–3 batches with 1 minute between each addition. This was the mixed for 5 minutes at 81° C. Next alkaline silicate was added and it was mixed while keeping it at 80° C. LAS acid was then added in 2–3 batches. Then the minor ingredients were added.

Example 5

A detergent powder comprising post dosed ingredients and a spray dried base powder is prepared wherein the sodium carbonate and sodium sulphate are in the form of a burkeite solid.

| Raw Material | Percent Formulation. |
|---|---|
| Base | |
| water | 4.53 |
| Sodium Silicate | 9.84 |
| Sodium LAS | 15.00 |
| nonionic, 30EO, C13–15 | 4.72 |
| Sodium Polyacrylate | 1.35 |
| Sodium Acrylate Maleate | 0.93 |
| Silicone | 0.01 |
| Sodium Carbonate (light) | 27.94 |
| Sodium sulphate | 34.44 |
| Post Dosed | |
| Sodium Perborate Monohydrate | 1.00 |
| Blue speckles | 0.50 |
| Fluorescent whitening agent | 0.13 |
| Total percentage | 100.00 |

The process used to make this powder is the same as the process described in example 4.

Example 6

A laundry detergent powder comprising post dosed ingredients and a spray dried base powder is prepared wherein the sodium carbonate and the sodium sulphate are in the form of independent solids.

| Raw Material | Percent Formulation. |
|---|---|
| Base | |
| water | 8.00 |
| Sodium Silicate | 8.00 |
| Sodium LAS | 12.80 |
| nonionic, 30EO, C13–15 | 3.20 |
| Sodium Acrylate Maleate | 0.75 |
| Silicone | 0.01 |
| Sodium Carbonate (light) | 37.00 |
| Sodium sulphate | 27.00 |
| Post Dosed | |
| Sodium Perborate Monohydrate | 1.00 |
| Blue speckles | 0.50 |
| Fluorescent whitening agent | 0.13 |
| Other detergent ingredients | 1.61 |
| Total percentage | 100.00 |

The process used to make the burkeite carrier spray dried powder is as follows. Ingredients were made into a 35–50% slurry with water then spray dried. The order of addition to prepare the slurry was first of all to add water and caustic solution and heat to 50° C. Next polymer and liquid nonionic were added and heated. LAS acid was then added. Neutral silicate was added and it was heated to 70° C. Next light soda ash was added and it was mixed for 5 minutes. Next sodium sulphate was added and it was dissolved for 2 min. Finally the minor ingredients were added.

Example 7

A laundry detergent powder comprising post dosed ingredients and a spray dried base powder is prepared wherein the sodium carbonate and sodium sulphate are in the form of a burkeite solid.

| Raw Material | Percent Formulation. |
|---|---|
| Base | |
| water | 4.00 |
| Sodium Silicate | 10.00 |
| Sodium LAS | 19.00 |
| nonionic, 20EO | 4.30 |
| Sodium carboxymethyl cellulose | 0.37 |
| Sodium polyacrylate | 1.30 |
| Sodium Carbonate (light) | 26.30 |
| Sodium sulphate | 33.30 |
| Fluorescent whitening agent | 0.19 |
| Post Dosed | |
| perfume | 0.30 |
| Blue speckles | 0.01 |
| Enzyme | 0.70 |
| Other detergent ingredients | 0.23 |
| Total percentage | 100.00 |

The process used to make this powder is as described in example 4.

Example 8

A laundry detergent powder comprising post dosed ingredients including enzymes and a spray dried base powder is prepared wherein the sodium carbonate and the sodium sulphate are in the form of a burkeite solid.

| Raw Material | Percent Formulation. |
|---|---|
| Base | |
| Water | 4.00 |
| Sodium Silicate | 10.00 |
| Sodium LAS | 24.00 |
| Nonionic, 30EO, C13–15 | 6.00 |
| Silicone | 0.02 |
| Sodium carboxymethyl cellulose | 0.37 |
| Sodium Polyacrylate | 1.30 |
| Sodium Carbonate (light) | 23.00 |
| Sodium sulphate | 30.00 |
| Fluorescent whitening agent | 0.19 |
| Post Dosed | |
| Perfume | 0.30 |
| Enzyme | 0.70 |
| Other detergent ingredients | 0.12 |
| Total percentage | 100.00 |

The process used to make this powder is as described in example 4.

Example 9

A laundry detergent powder comprising post dosed ingredients including enzymes and a spray dried base powder is prepared where the sodium carbonate and the sodium sulphate are in the form of a burkeite solid.

| Raw Material | Percent Formulation. |
|---|---|
| Base | |
| Water | 5.00 |
| Sodium Silicate | 9.58 |
| Sodium LAS | 17.70 |
| Nonionic, 20EO, branched | 4.30 |
| Silicone | 0.02 |
| Sodium carboxymethyl cellulose | 0.30 |
| Sodium polyacrylate | 1.30 |
| Sodium Carbonate (light) | 26.50 |
| Sodium sulphate | 33.50 |
| Fluorescent whitening agent | 0.08 |
| Post Dosed | |
| perfume | 0.30 |
| Enzyme | 0.70 |
| Other detergent ingredients | 0.72 |
| Total percentage | 100.00 |

The process used to make this powder is as described in example 4.

Example 10

A laundry detergent powder is prepared through a non-tower processing route.

| Raw Material | Percent Formulation |
|---|---|
| Sodium LAS | 17.40 |
| nonionic, 30EO, C13–15 | 4.36 |
| Sodium carbonate (light) | 70.00 |
| silica | 8.10 |
| Other detergent ingredients | 0.14 |
| Total Percentage | 100.00 |

The process used to make the carbonate non-tower formulation in example 10 was as follows. A Fukae FS30 high shear granulator was used with the agitator at 150 rpm and a chopper speed of 2000 rpm. The sodium carbonate was added to the mixer followed by the liquid LAS-acid and nonionic. Finally silica was added as a layering agent.

Example 11

A laundry detergent powder is prepared through a non-tower processing route.

| Raw Material | Percent Formulation |
|---|---|
| Sodium LAS | 15.10 |
| nonionic, 30EO, C13–15 | 3.78 |
| Sodium carbonate (light) | 40.90 |
| Sodium carbonate (dense) | 34.60 |
| silica | 5.60 |
| Other detergent ingredients | 0.02 |
| Total Percentage | 100.00 |

The process used to make the carbonate non-tower formulation in example 11 was as follows. A Fukae FS30 high shear granulator was used with the agitator at 150 rpm and a chopper speed of 2000 rpm. The sodium carbonate in the form of dense and light material and approximately 80% of the silica was added to the mixer followed by the liquid LAS-acid and nonionic. Finally the remaining 20% of the silica was added as a layering agent.

The invention claimed is:

1. A laundry detergent composition in the form of a particulate, paste, gel, or bar, the composition comprising;

(i) from 5 to 40 wt % of an anionic surfactant, (ii) from 1 to 20 wt % of a nonionic surfactant having a hydrophilic/lipophilic balance (HLB value) of from 13 to 25, (iii) optionally from 0 to 50 wt % of a cationic surfactant, (iv) optionally from 0 to less than 10 wt % of a detergency builder wherein the amount of a phosphate builder is from 0 to 5 wt %, (v) a polycarboxylate polymer that is present in an amount of up to 3 wt % and (vi) optionally other detergent ingredients to 100 wt %.

2. A detergent composition as claimed in claim 1, wherein the nonionic surfactant has a hydrophilic/lipophilic balance (HLB value) of from 14 to 19.5.

3. A detergent composition as claimed in claim 1, wherein the nonionic surfactant (ii) is an alkoxylated alcohol nonionic surfactant.

4. A detergent composition as claimed in claim 3, wherein the alkoxylated alcohol nonionic surfactant has a hydrophilic/lipophilic balance (HLB value) of from 15 to 20.

5. A detergent composition as claimed in claim 1, wherein the nonionic surfactant (ii) is an ethoxylated alcohol nonionic surfactant of the general formula I $$R—(—O—CH_2—CH_2)_n—OH \quad (I)$$

wherein R is a hydrocarbyl chain having from 8 to 16 carbon atoms, and the average degree of ethoxylation n is from 15 to 50.

6. A detergent composition as claimed in claim 5, wherein the ethoxylated alcohol nonionic surfactant has a hydrocarbyl chain containing from 10 to 16 carbon atoms.

7. A detergent composition as claimed in claim 5, wherein the ethoxylated alcohol nonionic surfactant has an average degree of ethoxylation n of from 16 to 40.

8. A detergent composition as claimed in claim 5, wherein the ethoxylated alcohol nonionic surfactant has a hydrocarbyl chain containing from 10 to 16 carbon atoms and an average degree of ethoxylation n of from 20 to 40.

9. A detergent composition as claimed in claim 1, wherein the composition is free from nonionic surfactants other than the nonionic surfactant (ii).

10. A detergent composition as claimed in claim 1, wherein the anionic surfactant (i) is an anionic sulphonate or sulphate surfactant.

11. A detergent composition as claimed in claim 10, wherein the anionic surfactant (i) is linear alkylbenzene sulphonate.

12. A detergent composition as claimed in claim 1, wherein the weight ratio of the anionic surfactant (i) to the nonionic surfactant (ii) is within the range of from 1:1 to 15:1.

13. A detergent composition as claimed in claim 1, wherein the cationic surfactant (iii) is a compound of the formula III:

$$R_1R_2R_3R_4N^+X^- \quad (III)$$

wherein $R_1$ is a $C_8$–$C_{18}$ hydrocarbyl chain, typically an alkyl, hydroxyalkyl or ethoxylated alkyl group, optionally interrupted with a heteroatom or an ester or amide group; each of $R_2$, $R_3$ and $R_4$ (which may be the same or different) is a short-chain ($C_1$–$C_3$) alkyl or substituted alkyl group; and X is a solubilising anion.

14. A detergent composition as claimed in claim 13, wherein in the cationic surfactant (iii) $R_1$ is a $C_8$–$C_{18}$ alkyl group, more preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups.

15. A detergent composition as claimed in claim 1, wherein the polycarboxylate polymer is selected from the group consisting of sodium polyacrylate, sodium acrylate maleate and mixtures thereof.

16. A detergent composition as claimed in claim 1, which is essentially free of detergency builder (iv).

17. A detergent composition as claimed in claim 1, which further comprises one or more additional surfactants in an amount of from 0 to 50 wt %, preferably from 0 to 10 wt %.

18. A detergent composition as claimed in claim 1, which further comprises one or more optional ingredients (vi) selected from soap, peroxyacid and persalt bleaches, bleach activators, air bleach catalyst, sequestrants, cellulose ethers and esters, cellulosic polymers, other antiredeposition agents, fluorescers, photobleaches, polyvinyl pyrrolidone, other dye transfer inhibiting polymers, foam controllers, foam boosters, acrylic and acrylic/maleic polymers, proteases, lipases, cellulases, amylases, other detergent enzymes, citric acid, soil release polymers, fabric conditioning compounds, coloured speckles, and perfume.

19. A detergent composition as claimed in claim 1, which is in powder form.

20. A process for laundering textile fabrics by machine or hand, which includes the step of immersing the fabrics in a wash liquor comprising water in which a laundry detergent composition as claimed in claim 1 is dissolved or dispersed.

* * * * *